US007616115B2

(12) United States Patent
Horak et al.

(10) Patent No.: US 7,616,115 B2
(45) Date of Patent: Nov. 10, 2009

(54) SENSOR FOR DETECTING HUMAN INTRUDERS, AND SECURITY SYSTEM

(75) Inventors: Dan T. Horak, Ellicott City, MD (US); Richard A. Burne, Ellicott City, MD (US)

(73) Assignee: Honeywell International Inc., Morristown, NJ (US)

( * ) Notice: Subject to any disclaimer, the term of this patent is extended or adjusted under 35 U.S.C. 154(b) by 354 days.

(21) Appl. No.: 11/705,656

(22) Filed: Feb. 13, 2007

(65) Prior Publication Data

US 2008/0191871 A1 Aug. 14, 2008

(51) Int. Cl.
*G08B 13/02* (2006.01)

(52) U.S. Cl. ..... 340/566; 340/522; 340/541; 340/565; 367/136

(58) Field of Classification Search ..... 340/566, 340/541, 551–554, 565, 522; 367/136, 178, 367/14

See application file for complete search history.

(56) References Cited

U.S. PATENT DOCUMENTS 3,824,532 A * 7/1974 Vandierendonck ..... 367/136
3,961,320 A 6/1976 Erdmann et al.
3,984,803 A 10/1976 Hawk et al.
4,001,771 A * 1/1977 Amrine et al. ..... 367/129
4,107,660 A 8/1978 Chleboun
4,347,590 A 8/1982 Heger et al.
5,021,766 A * 6/1991 Genahr et al. ..... 340/544
5,428,345 A 6/1995 Bruno
6,822,604 B2 11/2004 Hall et al.
7,057,974 B2 * 6/2006 Pakhomov et al. ..... 367/178
2004/0135683 A1 7/2004 Sakai
2005/0134450 A1 6/2005 Kovach

* cited by examiner

*Primary Examiner*—Toan N Pham
(74) *Attorney, Agent, or Firm*—Husch Blackwell Sanders Welsh & Katz

(57) ABSTRACT

A dual-modality sensor for detecting a presence of a human intruder within a secure setting includes a seismic sensor for acquiring a seismic signature of a disturbance, and includes an active acoustic sensor to acquire an acoustic signature of the disturbance. A system processor is electrically connected to the seismic and active acoustic sensors to receive and process the seismic and acoustic signatures, and generate an alarm signal when the disturbance is determined to come from a human intruder. Also included is an antenna and/or hard-wire connection arranged for communicating the alarm signal. The dual-modality sensor is arranged in a sensor housing constructed to contact a surface of the secure setting. The sensor may include a battery or other means for providing electrical power.

25 Claims, 6 Drawing Sheets

SENSOR FOR DETECTING HUMAN INTRUDERS, AND SECURITY SYSTEM

BACKGROUND OF THE INVENTION

1. Field of the Invention

The present invention relates to the detection of human intruders. More particularly, the invention as described and claimed herein relates to a dual-modality sensor constructed to accurately discern when movement detected within a secure setting, perimeter or border is human movement with a high probability of accuracy.

2. Description of the Related Art

In perimeter, border and building security applications, it is desirable to detect human intruders with a high probability of correct detection, and a low probability of false detection. False alarms are troubling in any security application, but much more so in critical security applications. Critical security applications require a response and/or investigation by security guards or personnel to any detected intrusion understood to be human. Where the detection is false, private security or local police must investigate nevertheless to verify the falsity. False alarm reports must be prepared and communicated. The entire false alarm operation, from investigation to reporting can be quite costly in terms of personnel response time, report preparation, and communication to local government and premise owners or managers. More importantly at times, false alarms generated by mistakenly detecting and falsely communicating a human intrusion may reduce a client's trust in a security system, or security system personnel associated with the false alarm raised.

Conventional human intruder sensing devices and systems may use various known sensor technologies to detect when a secure boundary has been breached. The sensor technologies include passive infrared (PIR) detectors, microwave detectors, seismic detectors, ultrasonic and other human motion detectors and systems. Such sensors detect human motion but also are susceptible to misidentifying non-human motion and falsely attributing the source of the non-human motion as human. False alarms are frequently raised when an animal breaches a secure border and is falsely detected and reported as a human intruder. For that matter, statistics show that most intruder detections generated by conventional motion-based perimeter and border security systems are the result of animal movement/intrusion rather than human. It follows that most alarms indicating a human intruder are false alarms (false positives).

Accordingly, there is a need for a new type of sensor, and security system using the sensor, which is capable of detecting or distinguishing human characteristics rather than mere motion to accurately qualify detections. By detecting human characteristics at a source of the motion, such a new and novel type sensor could better discern whether the source is human or non-human with many less false alarms. Preferably, such a new sensor and system would be inexpensive, battery-operated, and require no human assistance to distinguish between human and non-human intrusions.

SUMMARY OF THE INVENTION

To that end, the inventions described and set forth herein include a dual-modality sensor, and security system that utilizes the dual-modality sensor. The inventive dual-modality sensor accurately detects and discerns true human intrusions within perimeter, border and building security applications with a very low probability of false alarm reporting. The dual-modality sensor operates not merely on detected movement, but seeks to correlate detected movement with known characteristics of the human gait. Using human characteristics such as the human gait to competently verify that a source of a detected motion is truly human, or likely non-human, clearly distinguishes the dual-modality sensor operation from that of traditional motion sensors and security systems. The inventive dual-modality sensor includes two distinct sensing modalities, the data from which are fused together and processed. Fusing and/or correlating the dual signal information allows processing to verify presence of human gait characteristics in addition to seismic and velocity data. If the gait characteristic is verified with the other intrusion indicia, the source is human with a very high probability, and a very low probability that the human detection is a false positive. The two sensing modalities combined in the dual-modality sensor are: (1) a seismic step-detection sensor and (2) an active acoustic velocity profiling sensor.

In one embodiment, the invention comprises a security system including a command center and at least one dual-modality sensor, and a transmission line-based or wireless system communication means for electrically connecting the command center to the at least one dual-modality sensor. The dual-modality sensor includes a seismic sensor for detecting a seismic disturbance (e.g., a human footfall), and acquiring a seismic signature of the detected disturbance, and an active acoustic sensor. The active acoustic sensor is responsively activated by the seismic sensor at the detection of the seismic disturbance to acquire an acoustic signature representative of the disturbance. The dual modality sensor may include a microprocessor or microcontroller to carry out the fusing and/or correlating of the seismic and acoustic sensor data. Alternatively, or in addition, the security system may include a system processor electrically connected to the seismic and active acoustic sensors for processing data received therefrom. The received data are processed to correlate both sources and verify whether characteristics of the human gait are present in the processed data. Preferably, the dual-modality sensor includes a sensor housing arranged to contact a surface of the secure setting, and to house the seismic and active acoustic sensors therein.

BRIEF DESCRIPTION OF THE DRAWINGS

The foregoing and other objects, aspects and advantages will be better understood from the following detailed description of embodiments of the inventions, with reference to the drawings, in which.

DETAILED DESCRIPTION OF THE INVENTION

The inventive dual-modality sensor and its operation are described herein with the accompanying drawings in order to convey the broad inventive concepts. In particular, the drawings and descriptions herein are not meant to limit the scope and spirit of the invention, or in any way limit the invention as claimed.

Figure 1:
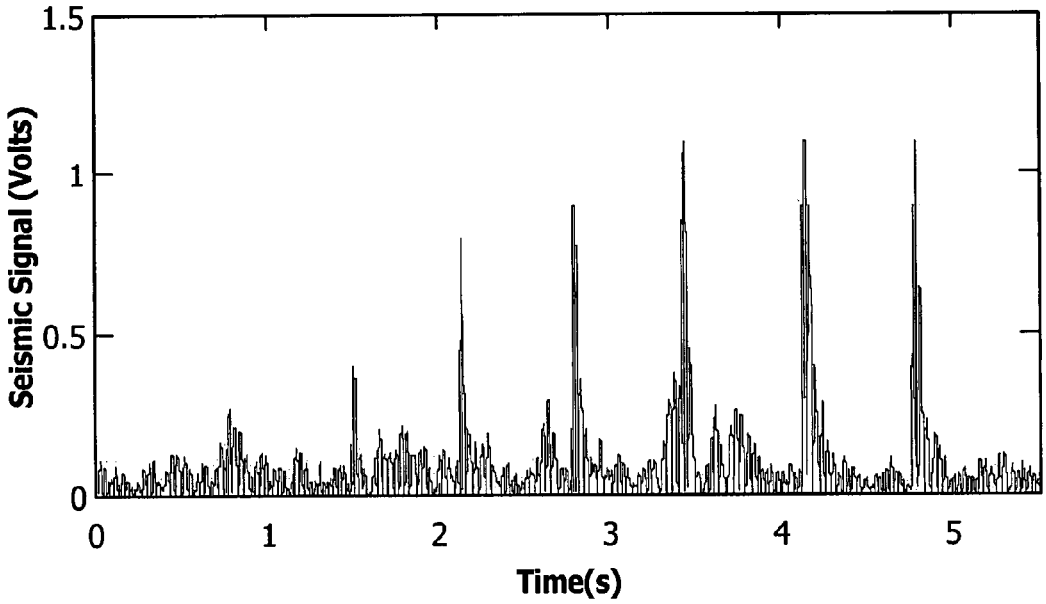
FIG. 1 is a seismic signature plot of a walking human (human gait) measured over time using a geophone.

FIG. 1 shows a seismic signature plot of a walking human (i.e., a human gait) derived from a conventional seismic sensor or seismic transducer. The seismic sensor is coupled to the ground or other solid surface to detect seismic perturbations upon the surface, e.g., made by animal or human footfalls. The feet of a walking human are known to impact a walking surface (e.g., the ground) at a rate that is generally in a range of about 80 to 120 steps per minute. Each foot's impact on the walking surface generates a seismic wave that propagates away from the footfall at the point of impact in all directions. Conventional seismic sensors detect the seismic waves or disturbances generated with each footfall as the waves pass the seismic sensor location. The seismic sensor undergoes an impulse excitation that generates an electrical signal correlated to the amount of seismic energy detected. A sequence of steps generates a sequence of impulse excitations that produce measurable electrical signals.

The particular signal shown in FIG. 1 is generated from a geophone seismic sensor ("geophone") in response to a man walking near the geophone. The plot is limited to six (6) easily detected seismic impulse excitations or detections from six (6) footfalls measured between 1.5 and 4.8 seconds in the time scale (abscissa). The typical size of such a geophone is about 2 cm in height, and 2 cm in diameter. The geophone may be coupled to the ground or other surface for monitoring by conventional fixation means, such as a spike affixed to or comprising the sensor housing. The spike maintains the geophone's seismic coupling contact with the surface. While a geophone is a preferred seismic sensor envisioned for use in the inventive dual-modality sensor, the invention is not limited to using a geophone as its seismic sensing means. The dual-modality sensor of the invention may comprise any seismic sensor means known to the skilled artisan that will allow dual-modality sensor operation as described herein. For example, an accelerometer, or like device, may be used in the invention to detect seismic disturbances (e.g., human footfalls) and generate a seismic signature of the disturbance.

The seismic signal depicted over time in FIG. 1 has two characteristics that indicate whether the source of the disturbance generating the signals is human footfalls. The first characteristic is that the impulse signal spacing in time is relatively uniform, indicative of a normal walking pattern. The second characteristic is that the step spacing is measured at about 91 steps per minute, corresponding to the typical range of human walking mentioned above. The characteristics may be extracted from the seismic signals in real time by a microcontroller or processor that can be built into the sensor. Seismic sensors such as geophones with such processing ability can effectively analyze seismic signal information to better detect human from non-human seismic disturbances, e.g., tripwire seismic sensors. Tripwire-based seismic sensors will generate a simple detection signal upon detection of any seismic transient.

But even a more sophisticated geophone, as described, may be misled into issuing a false alarm by mistakenly identifying a source of a seismic disturbance as human when it was non-human. Examples of such a non-human generators of seismic energy that can mislead a conventional geophone or like seismic sensor include a sequence of explosions at a distant location, a moving train, periodic pounding by a construction operation, running or walking animals, etc. To avoid such mistakes or false positive detections, the dual-modality sensor of the present invention includes not only a seismic sensing modality but also a second sensing modality to determine a velocity and gait of the source of the seismic disturbance. That is, it is not just the seismic disturbance that is assessed by the dual-modality sensor, but also whether the source of the seismic disturbance displays human movement velocity characteristics that correlate with the seismic footfall transients.

The physical principles that support the operation of the inventive dual-modality sensor are described below. Walking upright men or woman display a forward torso velocity that is relatively uniform, and which approximates his/her walking speed. The walking legs, however, experience a range of velocities. That is, while the head and hips move along with the torso velocity, the feet go from zero velocity to a maximum velocity and back to zero again with each step (footfall). The maximum walking foot velocity is about 2.5 times the average torso velocity. The velocity of a point on a leg such as the knee, which is about halfway between the hip joint and the foot, is somewhere in between the foot velocity and the torso velocity. Average walking speeds and the velocity of different body portions may be readily discerned by review of a video taken of a walker, or by an acoustic sensor or like device.

Figure 2:
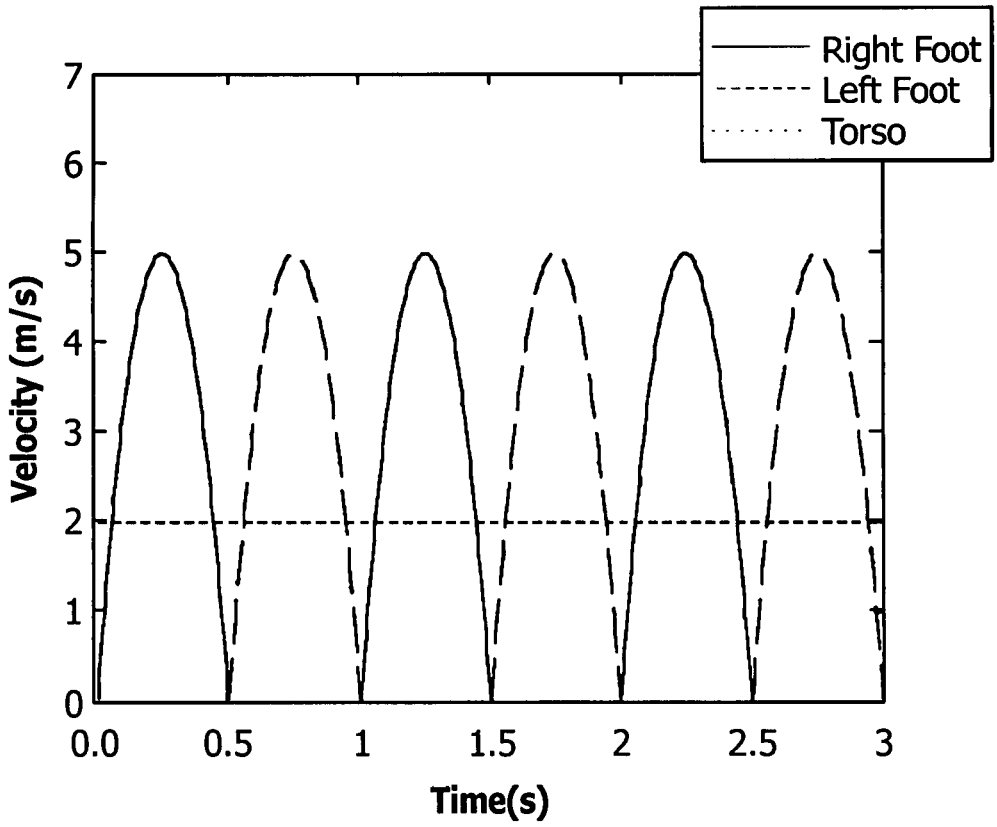
FIG. 2 is a velocity profile plot of a walking human (human gait) over time.

FIG. 2 depicts a velocity signal plot discerned from one or more videos of a man walking; the velocity signal is derived from the man's torso, right foot and left foot (velocity). The velocity signal indicates that the man is walking at a speed of about 2 meters per second (at the torso), displaying a peak foot speed of about 5 meters per second and footfall rate of about 120 steps per minute. A review of the velocity plot confirms that walking in a range of 90 to 120 steps per minute requires that both feet are momentarily at 0 (zero) velocity, when both feet are on the ground. The velocity signals shown in FIG. 2 also may be derived using an active acoustic sensor in an arrangement shown in detail with the walking man depicted in a FIG. 3 representation.

Figure 3:
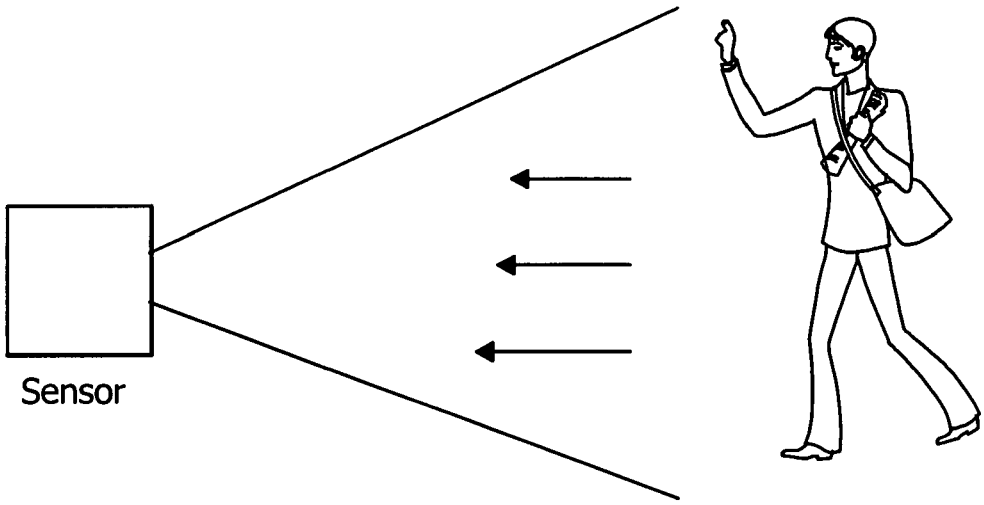
FIG. 3 is a representation of a walking man upon which are superimposed velocity vectors of the man's torso, upper leg and foot as he walks towards an active acoustic sensor.

That is, FIG. 3 is a depiction or representation of a man walking towards an active acoustic sensor, by which the FIG. 2 velocity signal could have been acquired. The FIG. 3 representation shows an acoustic signal beam from the active acoustic sensor (an ultrasonic transducer in the instant case) to the man's body, and the velocities of the man's foot, upper leg and hip joint (which is moving at torso velocity), represented by the arrows. When in transmit mode, the acoustic sensor projects an ultrasonic beam, the frequency ($f_t$) of which beam is fixed. Some portion of the acoustic energy (of the ultrasonic beam) is reflected from the man's torso, upper legs and feet back to the sensor. The reflected acoustic energy is received or acquired by the active acoustic sensor operating in receive mode. Due to the Doppler effect, the frequency components of the received acoustic energy differ from the fixed frequency ($f_t$) of the acoustic energy transmitted. These shifted frequency components carry information on the velocity characteristics of the walker.

The Doppler frequencies may be derived from the received/reflected acoustic signal using a discrete Fourier Transform (DFT). The DFT is implemented in a computer or microprocessor using a fast Fourier Transform (FFT) algorithm. Once a DFT is available from the computer or microprocessor, a plot of DFT magnitude over frequency is readily convertible to a plot of DFT magnitude over velocity. The DFT velocity abscissa values are computed from the DFT frequency abscissa values by:

$$v_{DFT}=(f_{DFT}/f_t-1)v_{sound}/2,$$

where $v_{DFT}$ is a velocity component of the man's walking gait, or speed detected at one body part, $f_{DFT}$ is the frequency shifted by one body part due to the Doppler effect, $f_t$ is the frequency of the ultrasonic transmitter (transmitted signal), and $v_{sound}$ is the velocity or speed of sound in air.

Figure 4:
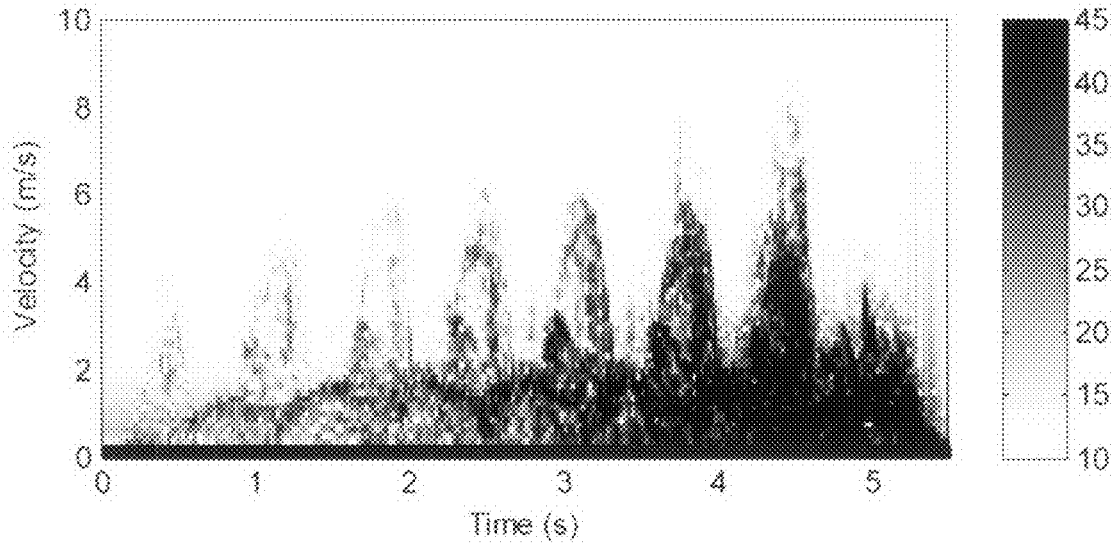
FIG. 4 is a spectrogram or velocity profile of a human walker who generated the seismic signature plot of FIG. 1.

FIG. 4 is a spectrogram of the velocity profile of the walking man whose footfalls generated the seismic signature plot of FIG. 1. The data shown were acquired with the active acoustic sensor arrangement similar to the one depicted in FIG. 3, where the man is represented as walking towards the active acoustic sensor. The FIG. 4 velocity spectrogram comprises a large number of DFT plots stacked together, where each stack represents a different point in time during the walk. Each DFT is represented by a vertical slice, wherein the log values of the DFT magnitude are color-coded. A difference of 10 on the color scale (the ordinate axis on the right side of the spectogram) corresponds to a factor of 10 in the magnitude difference. The FIG. 4 plot depicts about 7 well-defined steps by the man, where an $8^{th}$ step at time t=5 seconds (abscissa) is not well defined because the man's position is almost upon the sensor by the $5^{th}$ second of his walk (towards the sensor).

The reader should readily discern the similarity between the FIG. 2 velocity profile, drawn based on an examination of videos, and the FIG. 4 velocity spectrogram or profile, measured with the active acoustic sensor. However, even an active acoustic sensor acting alone can generate false alarms, i.e., falsely identify a non-human velocity as derived from a walking or running human. For example, the reader should consider a hypothetical case where only the first, third and fourth steps depicted in FIG. 4 were detected. The hypothetical includes assuming that the mover is far from the active acoustic sensor and not moving directly towards it. Three running dogs, three running deer, etc., crossing the field of view of the active acoustic sensor might also generate such an acoustic spectrogram or signature.

FIGS. 1-4 together evidence that both seismic step detectors and active acoustic gait detectors, when acting alone, are prone to falsely identify a non-human seismic disturbance and non-human movement as human. Such erroneous detections raise false alarms, as mentioned above. The dual-modality sensor of this invention overcomes the shortcomings of the described prior art sensors and their detection operation by combining the data acquired by each and executing a correlation operation to verify a presence of the human gait characteristic. That is, the seismic and acoustic data are fused or correlated, and human intruder detection alarms are issued only when the fused data indicates human gait associated with the seismic disturbance.

Figure 5:
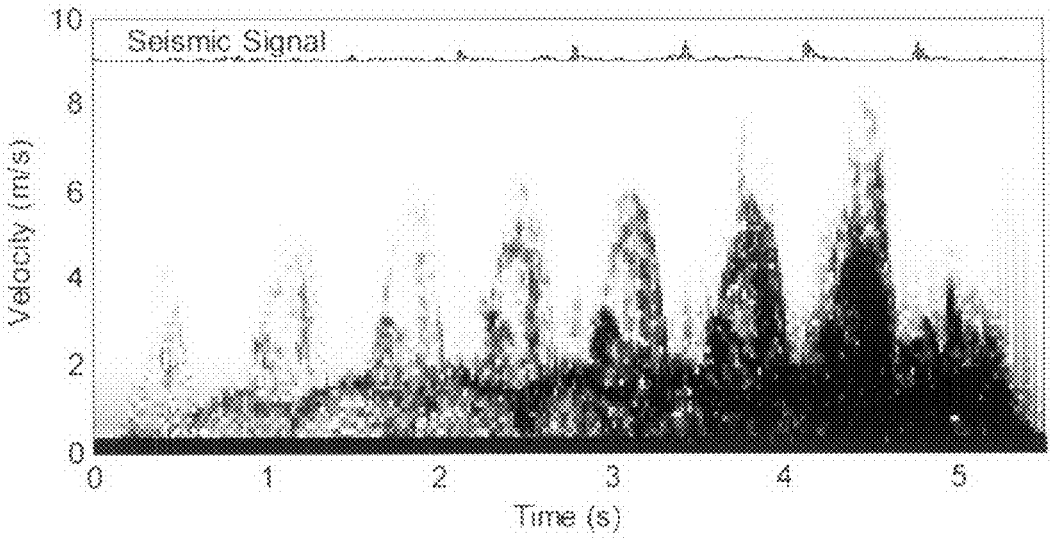
FIG. 5 is a combined plot of a seismic footstep signature of FIG. 1, and the active acoustic velocity profile or spectrogram of FIG. 4.

FIG. 5 shows a combined plot of the walking man's seismic footstep signature as seen in FIG. 1 (not drawn here to scale), and the acoustic velocity signature or spectrogram of FIG. 4. The seismic and acoustic information is used by the dual-modality sensor in an attempt to correlate seismic and acoustic data with human gait characteristic. More particularly, FIG. 5 shows that seismic transients, derived from the seismic sensor portion of the dual-modality sensor, occur in between the active acoustic peaks, when the acoustic signal (derived from the active acoustic sensor portion) is at a local minimum. This is due to the fact that at the instant when a foot strikes the walking surface, the foot velocity is zero. A correlation between the peaks of the seismic signals and the troughs of the velocity signature is a strong indication that the signatures were made by a walking human. That is, where there is a correlation of the human gait characteristic found by processing the fused seismic and velocity signatures, simple deduction supports a conclusion that the seismic transients could not have been generated by a sequence of explosions at a remote location, or hammering rhythmically, etc. Such a source of seismic disturbance could not account for the active acoustic signature at the velocity minimums or troughs. It may be further assumed that three dogs moving at a velocity could not cause the acoustic signature because it would not explain the timing of the seismic transients. Therefore, correlating the acquired seismic and acoustic signatures (FIG. 5) verifies with a very high probability that a walking human did or did not generate the seismic disturbance.

Figure 6:
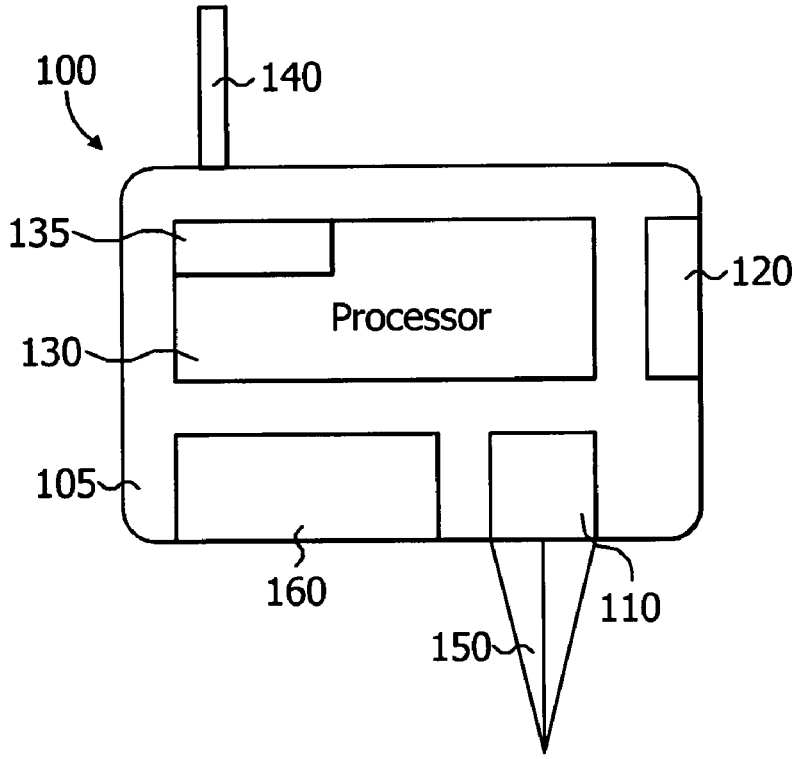
FIG. 6 is one embodiment of a dual-modality intrusion sensor of the invention.

FIG. 6 shows one embodiment of a dual-modality sensor 100 of the invention arranged in a housing 105. The physical dimensions of housing 105 are about 5 cm×5 cm×8 cm. The reader and skilled artisan should recognize that the housing dimensions are presented for exemplary purposes only, and not to limit sensor or housing dimensions in any way. The dual-modality sensor 100 includes a geophone 110, an active acoustic transducer 120, a processor 130 with A/D converter to acquire and process the sensor signals, a transmitter 135 and antenna 140 for transmitting an alarm signal and/or intruder information to a security command center (shown in the FIG. 9 embodiment). A ground spike 150 is included for coupling the dual-modality sensor to the ground or other surface, as well as a battery (160). For indoor operations, some means other than ground spike 150 would be included to fix the dual-modality sensor to and the indoor surface, e.g., tape. While battery operation is preferred, a variation on the design may include a power connector and, for example, a DC power supply to allow hard-wired AC operation for a stand-alone dual modality sensor.

Figure 7:
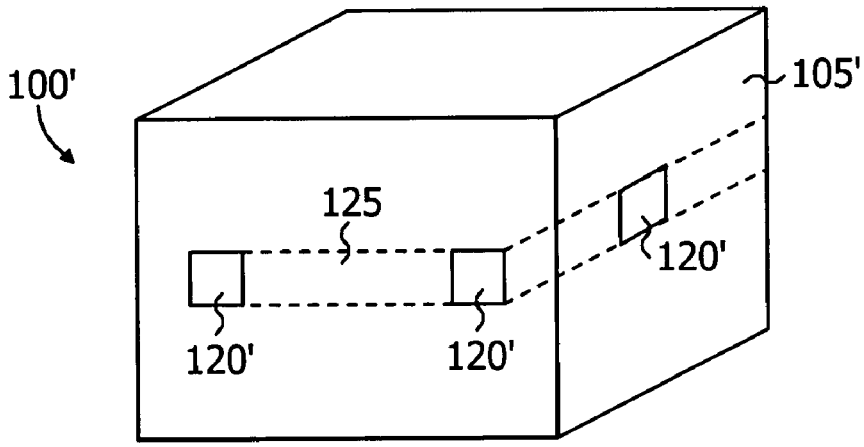
FIG. 7 shows another embodiment of a dual-modality sensor of the invention.

FIG. 7 shows an alternative embodiment of a dual-modality sensor 100.' In the FIG. 7 embodiment, the sensor 100' includes an active acoustic transducer array 125 constructed with a plurality of active acoustic sensors 120' positioned about the perimeter of a sensor housing 105'. With active acoustic sensors 120' positioned as shown, upon activation, the dual-modality sensor 100' may poll an area that is larger than the area covered by the single, forward polling active transducer 120, such as depicted in the FIG. 6 embodiment. The dual-modality sensor housing 105' may comprise various shapes that allow individual transducers or acoustic sensors 120' to transmit and receive. Preferably, sensors 120' are arranged to detect at angular directions that are perpendicular to the normal of the surface of transducer 120'. The microcontroller or microprocessor controls internal operation of the FIG. 7 embodiment, including controlling transducer operation, i.e., transmitting and receiving.

Figure 8:
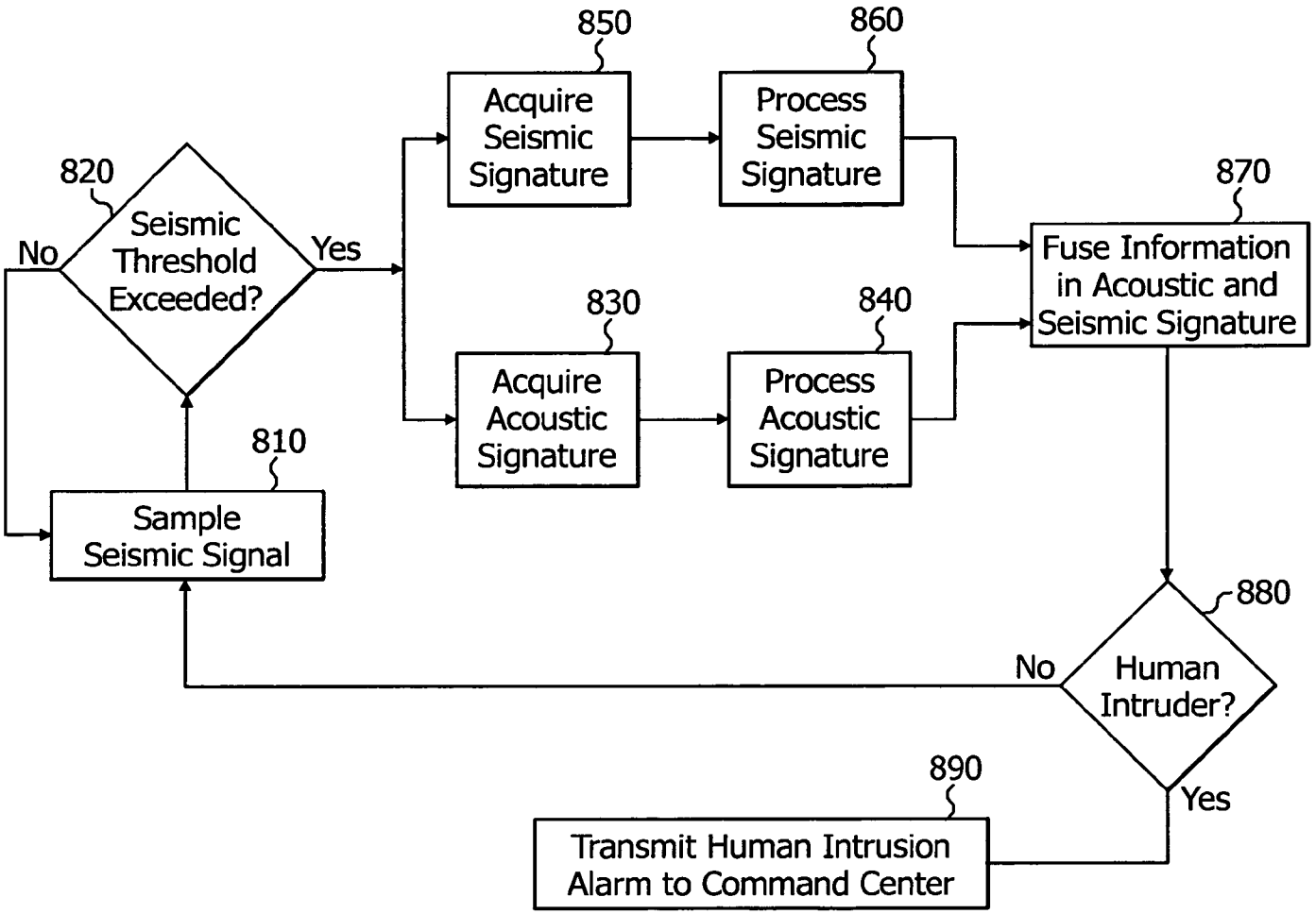
FIG. 8 is a schematic block diagram highlighting one mode of the inventive sensing operation of a dual-modality sensor of the invention.

FIG. 8 is a functional block diagram that highlights the operation of a dual-modality sensor of the invention, e.g., device 100 of FIG. 6. It should be mentioned that for most operations, the dual-modality sensor 100 spends most of its operational time in a semi-inactive state, waiting to detect a seismic intrusion trigger. To do so, the sensor continuously acquires and samples seismic signal data and compares the sampled seismic signal data to a threshold signal level. Since the geophone sensor is a passive sensor, the operation may be performed in the embodiment shown with about 1 mW of power when implemented digitally, and with much less power if implemented with analog circuitry. The left side of the functional block diagram of FIG. 8 shows the operation of the seismic triggering function. That is, operation begins at block 810, representative of a step of sensing and sampling seismic signals. Block or diamond 820 is representative of a comparison made between the magnitude of a sensed seismic signal and the known threshold. If the sensed signal does not exceed the threshold, the step represented by block 810 is repeated, and so on, until the sensed signal is found to exceed the seismic threshold.

When a seismic disturbance is detected in a proper range by the step of block 820 (exceeding the threshold), the dual-modality sensor activates the active acoustic sensor as represented by block 830. When activated, the acoustic sensor acquires an acoustic profile of the source of the seismic disturbance. Substantially simultaneously with the triggered active acoustic sensor operation, the seismic sensor maintains sampling of the seismic event to acquire seismic data to form a seismic signature, as represented by block 850. The duration of the acquisition of the seismic and acoustic signatures sufficient for inventive operation is approximately five (5) seconds. The inventive operation, however, is not limited to a five (5) second data acquisition period, but may acquire data for more than, or less than five (5) seconds, depending on acoustic and seismic data characteristics. Blocks 840 and 860 represent steps wherein the acoustic and seismic signatures are respectively processed. After processing, the signatures are fused or combined in a step represented by block 870. Block or diamond 880 represents a step where the fused signature information is analyzed for correlation between the seismic and velocity data to determine if it reflects human characteristics, e.g., human gait.

If a correlation is found for more than a predetermined number of steps, e.g., three (3) steps or more, a human intruder alarm is issued and transmitted to a command center as represented by block 890. Alarm messages contained within a generated alarm signal or communication may include a numerical estimate of a probability of correct detection attached to them. Such operation would allow a security command center to decide if and how to respond to the alarm messages. If no correlation is found, no alarm is raised and processing resumes at block 810.

Figure 9:
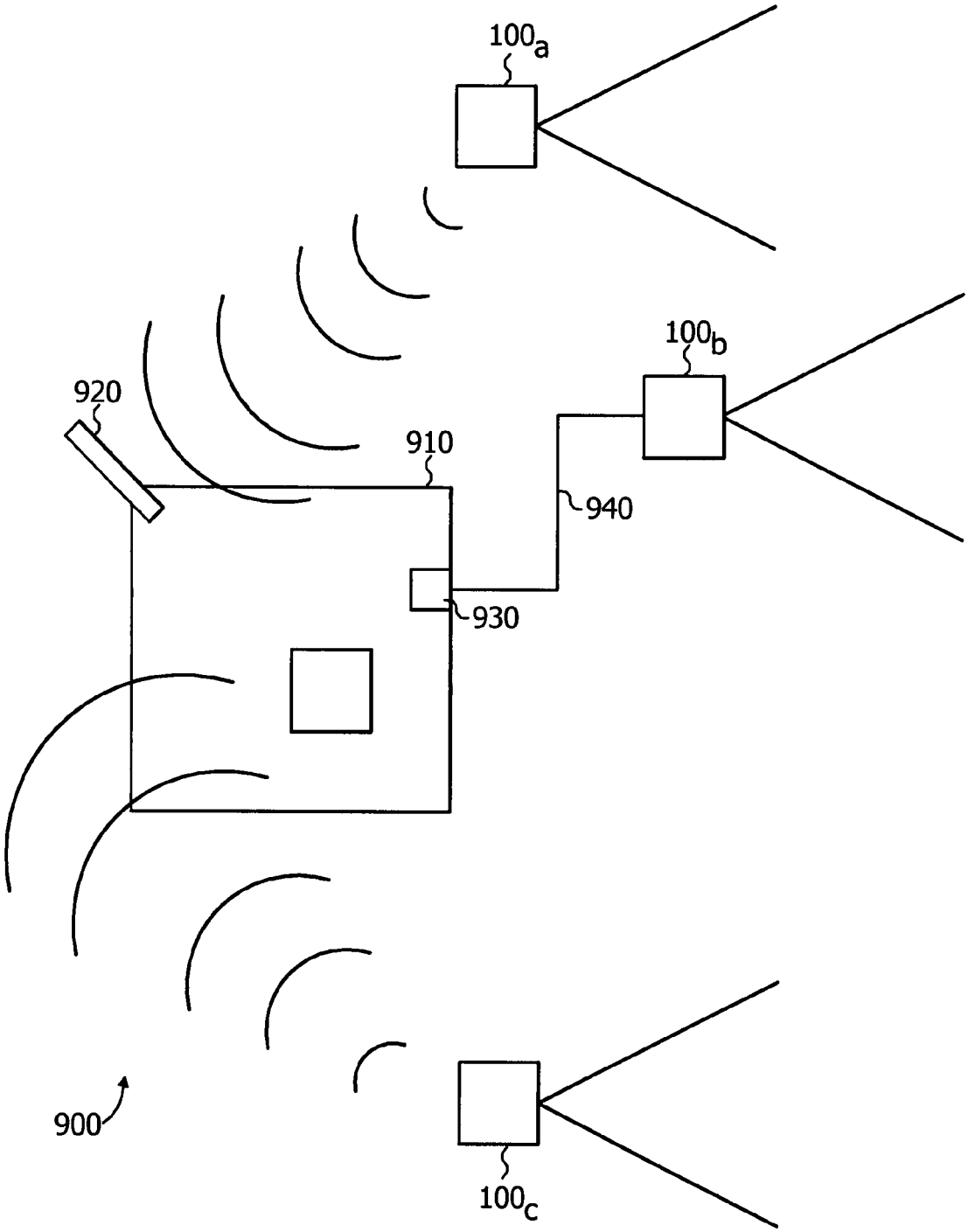
FIG. 9 is a system block diagram of a security system that includes at least one dual-modality sensor of the invention.

FIG. 9 is a schematic block diagram of a security system 900 of the invention. Security system 900 is shown to include three dual-modality sensors 100*a*, 100*b* and 100*c*. Sensors 100*a* and 100*c* communicate with the command center 900 through antenna 920 (wireless), and sensor 100*b* communicates to the command center through a port 930, and a transmission line 940 (hard-wired). The wireless communicating may be carried out according to any standard. A processor 950 within the command center 910 processes signals received from the dual-modality sensors. Those signals may include an alarm signal generated within any of the three dual-modality sensors shown, or may include the acoustic and seismic signature signals. Hence, the processor and command center process to determine whether the seismic disturbance was human initiated using the signatures, triangulation, etc. An alarm may be raised by any method or structure known to the skilled artisan.

Although a few examples of the present invention have been shown and described, it would be appreciated by those skilled in the art that changes may be made in these embodiments without departing from the principles and spirit of the invention, the scope of which is defined in the claims and their equivalents.

What is claimed is:

1. A dual-modality sensor for detecting human intruders to a secure setting, comprising:

a seismic sensor for detecting and measuring seismic disturbances;

an active acoustic sensor for acquiring a Doppler effect acoustic signature from acoustic energy reflected from a source of the detected seismic disturbance; and a processor for processing and correlating the measured seismic disturbance and the active acoustic signature to verify a presence of a human characteristic therein, and for generating a human intruder alarm signal where said human characteristic presence is verified.

2. The dual-modality sensor as set forth in claim 1, wherein the seismic sensor allows the active acoustic sensor to acquire the acoustic signature when the seismic sensor determines that the detected seismic disturbance meets a seismic threshold level.

3. The dual modality sensor as set forth in claim 2, wherein the seismic sensor generates a seismic trigger signal upon its determination that the seismic disturbance meets the seismic threshold level.

4. The dual-modality sensor as set forth in claim 3, wherein the active acoustic sensor is activated by the seismic trigger signal.

5. The dual-modality sensor as set forth in claim 3, wherein the measured seismic disturbance and acoustic signature are measured for a fixed time period in response to the seismic trigger signal.

6. The dual-modality sensor as set forth in claim 3, wherein the processor may generate the trigger signal to acquire an acoustic signature related to the measured seismic disturbance upon one of: periodically, in response to a command signal received at the dual-modality sensor, and in response to an ambiguous processing result.

7. The dual-modality sensor as set forth in claim 1, further comprising a sensor housing arranged to contact a surface comprising the secure setting, which houses the seismic sensor, the active acoustic sensor and the processor.

8. The dual-modality sensor as set forth in claim 7, wherein the housing comprises spike for coupling to the surface.

9. The dual modality sensor as set forth in claim 7, wherein the active acoustic sensor comprises an array of ultrasonic transducers arranged to acquire acoustic signature data in a field that exceeds the field that a single active acoustic sensor can cover.

10. The dual-modality sensor as set forth in claim 1, further comprising an electrical power source.

11. The dual-modality sensor as set forth in claim 10, wherein the electrical power source is a battery.

12. The dual-modality sensor as set forth in claim 1, further including a transmitter for communicating the human intruder alarm signal.

13. The dual modality sensor as set forth in claim 12, further comprising an antenna for sending and receiving signals.

14. The dual modality sensor as set forth in claim 13, wherein the antenna transmits the measured seismic disturbance data and the acoustic signature.

15. The dual modality sensor as set forth in claim 13, wherein the antenna transmits the human intruder alarm signal.

16. The dual modality sensor as set forth in claim 12, wherein the seismic sensor is a geophone.

17. The dual modality sensor as set forth in claim 1, wherein the active acoustic sensor is a piezoelectric transducer.

18. A security system for protecting a secure setting, comprising:

a command center including a command center processor;

at least one dual-modality sensor in communication with the command center for detecting a presence of a human intruder within the secure setting, comprising:

a seismic sensor for detecting and measuring a seismic disturbance;

an active acoustic sensor for acquiring a Doppler effect acoustic signature from acoustic energy reflected from a source of the detected seismic disturbance; and a sensor processor for processing and correlating the measured seismic disturbance and acoustic signature and generating an alarm signal if a correlation is found by said processing indicative of a human gait; and means for communicating with the at least one dual-modality sensor.

19. The security system as set forth in claim 18, wherein the at least one dual-modality sensor includes a sensor housing arranged to contact a surface comprising the secure setting, and which houses the seismic sensor, the active acoustic sensor, and the sensor processor.

20. The security system as set forth in claim 18, wherein the seismic sensor generates a trigger signal if it determines that the seismic disturbance exceeds a predetermined seismic threshold value.

21. The security system as set forth in claim 20, wherein the trigger signal activates the active acoustic sensor to acquire acoustic data.

22. The security system as set forth in claim 18, wherein the dual-modality sensor includes an antenna.

23. The security system as set forth in claim 22, wherein the sensor processor communicates the alarm signal to the command center upon determining that the disturbance was human-generated.

24. The security system as set forth in claim 22, wherein the at least one dual-modality sensor communicates the measured seismic disturbance and acoustic signature to the command center for processing to identify indicia of human gait.

25. The security system as set forth in claim 18, wherein all signals exchanged between the command center and the at least one dual-modality sensor are encrypted.

* * * * *